US007764807B2

(12) United States Patent
Roemer et al.

(10) Patent No.: US 7,764,807 B2
(45) Date of Patent: Jul. 27, 2010

(54) SPEAKER SUPPORT SYSTEMS

(75) Inventors: Daniel Frank Roemer, Oregon, WI (US); Chad A. Kautz, Winslow, IL (US); Jason A Planck, Monroe, WI (US)

(73) Assignee: Mitek Corp., Inc, Monroe, WI (US)

( * ) Notice: Subject to any disclaimer, the term of this patent is extended or adjusted under 35 U.S.C. 154(b) by 656 days.

(21) Appl. No.: 11/745,885

(22) Filed: May 8, 2007

(65) Prior Publication Data

US 2008/0279413 A1 Nov. 13, 2008

(51) Int. Cl.
*H04R 1/02* (2006.01)

(52) U.S. Cl. ..... 381/395; 381/389; 381/392

(58) Field of Classification Search ..... 381/395
See application file for complete search history.

(56) References Cited

U.S. PATENT DOCUMENTS

RE18,751 E * 2/1933 Weinberger ..... 381/432
4,797,935 A * 1/1989 Tanaka ..... 381/392
4,939,783 A * 7/1990 Dunning ..... 381/386
6,058,199 A * 5/2000 Umitsu ..... 381/395
6,684,977 B2 2/2004 Stuart

* cited by examiner

*Primary Examiner*—Curtis Kuntz
*Assistant Examiner*—Matthew Eason
(74) *Attorney, Agent, or Firm*—Keith L. Jenkins, Registered Patent Attorney, LLC; Keith L. Jenkins

(57) ABSTRACT

A speaker support system, adapted to prevent destructive resonance between a speaker and a speaker cabinet, comprising a vibration damper, a vibration transferer, and a connector. The speaker support prevents primary-mode resonance from building up to damaging levels in a speaker cabinet.

The vibration damper damps sound vibrations that are passing from a speaker into a speaker cabinet. The vibration damper is tuned to not resonate at any resonant frequency of the speaker cabinet. The vibration transferer transfers sound vibrations from the vibration damper to a vibration sink, which is preferably a portion of the speaker cabinet that is remote from the vibration damper. Preferably, the vibration transferer comprises a metal rod. The connector fixedly connects the vibration transferer to the vibration sink. The vibration transferer is tuned to not resonate at any resonant frequency of the speaker cabinet.

19 Claims, 3 Drawing Sheets

SPEAKER SUPPORT SYSTEMS

FIELD OF THE INVENTION

The present invention relates to speaker support systems. More particularly, the present invention relates to a speaker support system adapted to prevent destructive resonance between a speaker and a speaker cabinet.

BACKGROUND OF THE INVENTION

Modern automotive audio stereo systems may include woofers weighing in excess of 300 lbs. The power output of such large woofers, coupled with the necessity of minimizing cabinet size and weight, the frequency range of woofers, and operation while in motion, has created a problem. Large automotive woofers can destroy themselves, either by cracking the anterior portion of the basket, or by destroying woofer cabinets by resonant shaking of the cabinet.

Therefore, a need exists for a speaker support that prevents destructive resonance between a speaker and a speaker cabinet and which simultaneously assists in maintaining the structural integrity of the basket.

OBJECTS AND FEATURES OF THE INVENTION

A primary object and feature of the present invention is to provide a speaker support system. It is a further object and feature of the present invention to provide such a system that prevents destructive resonance between a speaker and a speaker cabinet. It is yet another object and feature of the present invention to provide such a system that transfers vibrations away from an interface between a speaker and a speaker cabinet while damping primary-mode resonance in the speaker cabinet.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a speaker support, comprising: at least one vibration damper structured and arranged to damp sound vibrations that are passing from at least one speaker into at least one speaker cabinet supporting such at least one speaker; at least one vibration transferer adapted to transfer such sound vibrations from such at least one vibration damper to at least one vibration sink; at least one connector adapted to connect such at least one vibration transferer to such at least one vibration sink; wherein such at least one vibration transferer is tuned to not resonate at any resonant frequency of such at least one speaker cabinet.

Moreover, it provides such a speaker support, further comprising such at least one speaker cabinet, wherein such at least one vibration transferer comprises at least one length that is not an integer, a dividend, or a product of any side length or diagonal length of such at least one speaker cabinet. Additionally, it provides such a speaker support, wherein such at least one vibration transferer comprises metal. Also, it provides such a speaker support, wherein such at least one vibration transferer comprises at least one metal rod. In addition, it provides such a speaker support, wherein such at least one connector comprises at least one metal bracket. And, it provides such a speaker support, wherein such at least one vibration damper is compressed between such at least one speaker and such at least one speaker cabinet. Further, it provides such a speaker support, wherein such at least one vibration damper is fastened between such at least one speaker and such at least one speaker cabinet and is in direct contact with such at least one speaker and with such at least one speaker cabinet.

Even further, it provides such a speaker support, wherein such at least one vibration damper comprises at least one fastener-hole adapted to receive at least one fastener. Moreover, it provides such a speaker support, wherein such at least one vibration damper comprises at least one metal plate. Additionally, it provides such a speaker support, wherein such at least one vibration damper comprises at least one annulus having a plurality of fastener-holes arrayed about the circumference of such at least one annulus. Also, it provides such a speaker support, wherein such at least one vibration damper comprises six fastener-holes arrayed in at least one hexagonal pattern about the circumference of such at least one annulus. In addition, it provides such a speaker support, further comprising such at least one speaker. And, it provides such a speaker support, wherein such at least one speaker comprises at least one woofer. Further, it provides such a speaker support, further comprising such at least one speaker cabinet. Even further, it provides such a speaker support, further comprising such at least one vibration sink. Even further, it provides such a speaker support, wherein such at least one vibration sink comprises such at least one speaker cabinet.

In accordance with another preferred embodiment hereof, this invention provides a speaker support, comprising: at least one metal vibration damper structured and arranged to damp sound vibrations that are passing from at least one speaker into at least one proximate portion of at least one speaker cabinet that is supporting such at least one speaker; at least one metal vibration transferer adapted to transfer such sound vibrations from such at least one vibration damper to at least one remote portion of such at least one speaker cabinet; and at least one metal connector adapted to connect such at least one vibration transferer to such at least one remote portion of such at least one speaker cabinet; wherein such at least one vibration transferer is tuned to not resonate at any primary-mode resonant frequency of such at least one speaker cabinet; whereby such sound vibrations are transferred from such at least one speaker to such at least one remote portion of such at least one speaker cabinet.

In accordance with another preferred embodiment hereof, this invention provides a speaker support, comprising: at least one speaker comprising at least one speaker basket; at least one speaker cabinet adapted to support such at least one speaker; at least one vibration damper structured and arranged to damp sound vibrations that are passing from such at least one speaker basket into at least one proximate portion of such at least one speaker cabinet; wherein such at least one vibration damper is fastened between such at least one speaker basket and such at least one speaker cabinet and is in direct contact with such at least one speaker basket and with such at least one speaker cabinet; wherein such at least one vibration damper comprises a plurality of fastener-holes arrayed about the circumference of at least one annular plate; at least one vibration transferer adapted to transfer such sound vibrations from such at least one vibration damper to at least one remote portion of such at least one speaker cabinet; wherein such at least one vibration transferer comprises at least one metal rod; at least one connector adapted to connect such at least one vibration transferer to such at least one remote portion of such at least one speaker cabinet; wherein such at least one vibration transferer is tuned to not resonate at any primary-mode resonant frequency of such at least one speaker cabinet; whereby such sound vibrations are transferred from such at least one speaker to such at least one remote portion of such at least one speaker cabinet. Even further, it provides such a speaker support, wherein such at least one vibration damper comprises six fastener-holes arrayed in at least one hexagonal pattern about the circumference of such at least one annular plate. Even further, it provides such a speaker support, wherein such at least one speaker comprises at least one woofer adapted to be mounted in at least one automobile.

DETAILED DESCRIPTION OF THE BEST MODES AND PREFERRED EMBODIMENTS OF THE INVENTION

Figure 1:
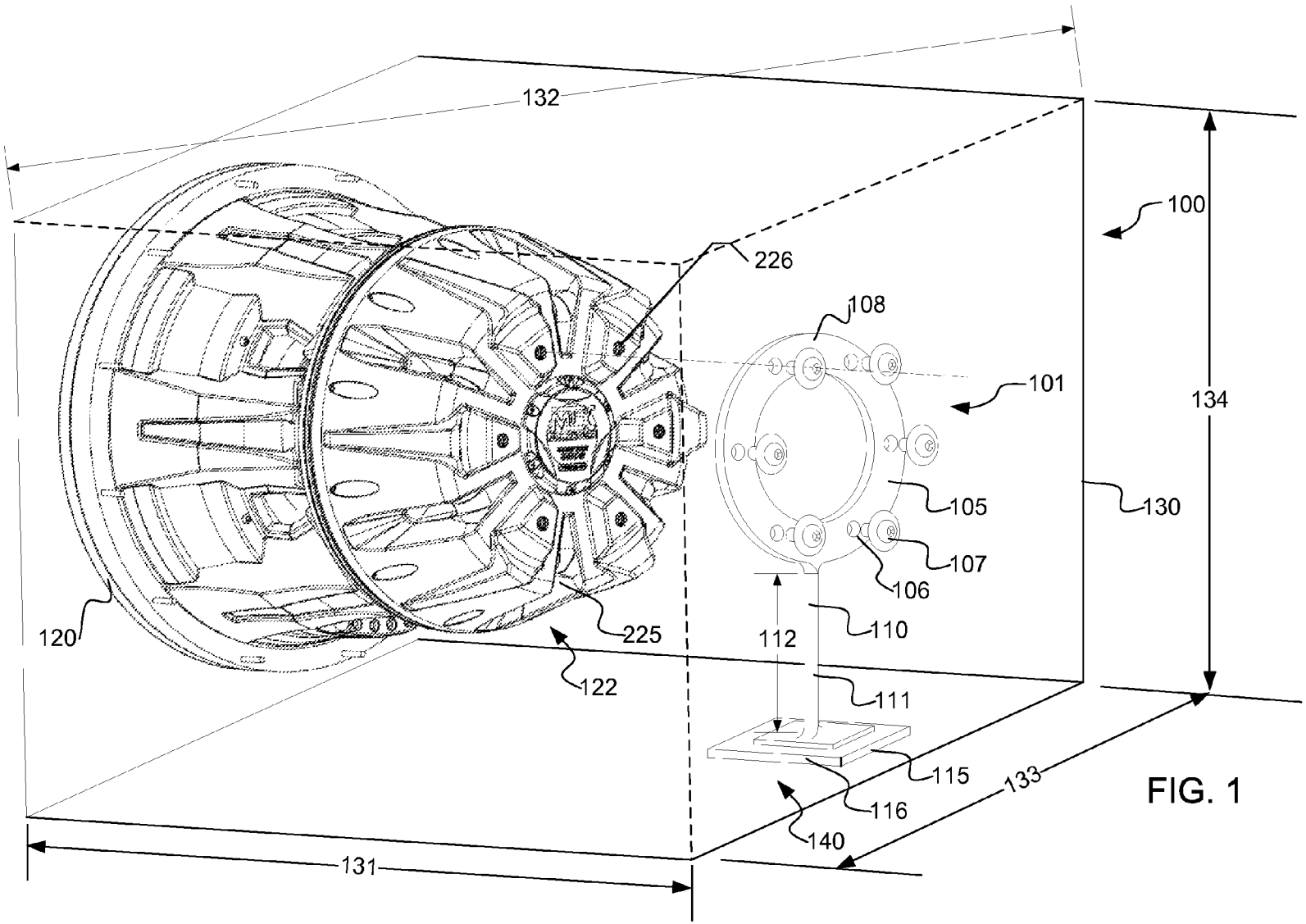
FIG. 1 shows a perspective view illustrating the speaker support according to a preferred embodiment of the present invention.

FIG. 1 shows a perspective view illustrating speaker support 101 according to a preferred embodiment of the present invention. Speaker support system 100 comprises speaker support 101, as shown. Speaker support 101 comprises vibration damper 105, vibration transferer 110, and connector 115, as shown. Speaker support system 100 comprises speaker 120, as shown. Speaker 120 may be a woofer, as shown. Speaker support system 100 comprises speaker cabinet 130, as shown. Speaker support system 100 comprises vibration sink 140, as shown. A portion of speaker cabinet 130, remote from vibration damper 105, comprises vibration sink 140. Preferably, speaker cabinet 130 is adapted to be installed in an automobile. Preferably, speaker cabinet 130 comprises at least one of wood, plastic, metal, etc.

Vibration damper 105 damps sound vibrations (defined herein as any vibrations generated by speaker 120) that are passing from speaker 120 into speaker cabinet 130. Preferably, vibration damper 105 damps sound vibrations that are passing from speaker 120 into at least one proximate portion of speaker cabinet 130. Speaker cabinet 130 physically supports, encloses, and protects speaker 120. Vibration damper 105 is tuned to not resonate at any primary resonant frequency of speaker cabinet 130.

Vibration transferer 110 transfers sound vibrations from vibration damper 105 to vibration sink 140. In particular alternate embodiments, vibration transferer 110 may be a multi-membered structure, such as a tripod or a truss. Preferably, vibration sink 140 comprises a portion of speaker cabinet 130 that is remote from vibration damper 105, as shown. Vibration sink 140 is preferably a panel of the speaker cabinet 130 that is installed against an environmental surface, such as the floor of the speaker cabinet 130 resting on a floor of an automobile. Preferably, vibration transferer 110 comprises metal. Preferably, vibration transferer 110 comprises metal rod 111. In some embodiments, vibration transferer 110 may further comprise a vibration damping elastomer. Upon reading the teachings of this specification, those with ordinary skill in the art will now understand that, under appropriate circumstances, considering such issues as advances in technology, user preference, materials properties, etc., other vibration transferers, such as transferers made of other materials or composites, other shapes of transferers, multiple vibration transferers attached to one vibration damper, etc., may suffice.

Connector 115 fixedly connects vibration transferer 110 to vibration sink 140, as shown. Preferably, connector 115 comprises metal bracket 116, as shown. Connector 115 is preferably not co-located with the point of maximum deflection (such as the center) of the vibration sink 140. Upon reading the teachings of this specification, those with ordinary skill in the art will now understand that, under appropriate circumstances, considering such issues as advances in technology, user preference, etc., other connectors, such as brackets made of other materials or composites, adhesive, no differentiated connector where the vibration transferer is in contact with the vibration sink, etc., may suffice.

Vibration transferer 110 is tuned to not resonate at any primary resonant frequency of speaker cabinet 130 or at any primary resonant frequency of any panel (such as vibration sink 140) thereof. Preferably, length 112 of vibration transferer 110 is not an integer dividend or an integer product of any side length 131, 133, or 134 or diagonal length 132 of speaker cabinet 130. Preferably, the stiffness, diameter, material, etc., of vibration transferer 110 are selected to tune vibration transferer 110 to not resonate at any primary-mode resonant frequency of speaker cabinet 130. Preferably, vibration transferer 110 also damps a portion of the sound vibrations without transferring them to vibration sink 140.

Vibration damper 105 is adapted to be fixedly fastened to speaker 120, as shown. More preferably, vibration damper 105 is adapted to be fixedly fastened to basket 225 of speaker 120, as shown. Even more preferably, vibration damper 105 is adapted to be fixedly fastened to at least one anterior portion 122 of basket 225 of speaker 120, as shown.

Preferably, vibration damper 105 comprises at least one annular metal plate, as shown. Preferably, vibration damper 105 comprises at least one fastener-hole 106 adapted to receive fastener 107, as shown. Preferably, vibration damper 105 comprises annular plate 108 having a plurality of fastener-holes 106 arrayed about the circumference of annular plate 108, as shown. Preferably, vibration damper 105 comprises six fastener-holes 106 arrayed in a hexagonal pattern about the circumference of annular plate 108, as shown.

Fastener-holes 106 align with basket fastener-holes 226 in basket 225, as shown. Fasteners 107 pass through fastener-holes 106 and into basket fastener-holes 226, as shown. Vibration damper 105 structurally reinforces anterior portion 122 of basket 225 when attached. Upon reading the teachings of this specification, those with ordinary skill in the art will now understand that, under appropriate circumstances, considering such issues as advances in technology, user preference, etc., other adaptations to assist the vibration damper in structurally reinforcing the speaker basket 225, such as contouring the vibration damper 105 to the shape of the speaker basket 225, other sizes, other shapes, other materials, etc., may suffice.

Figure 2:
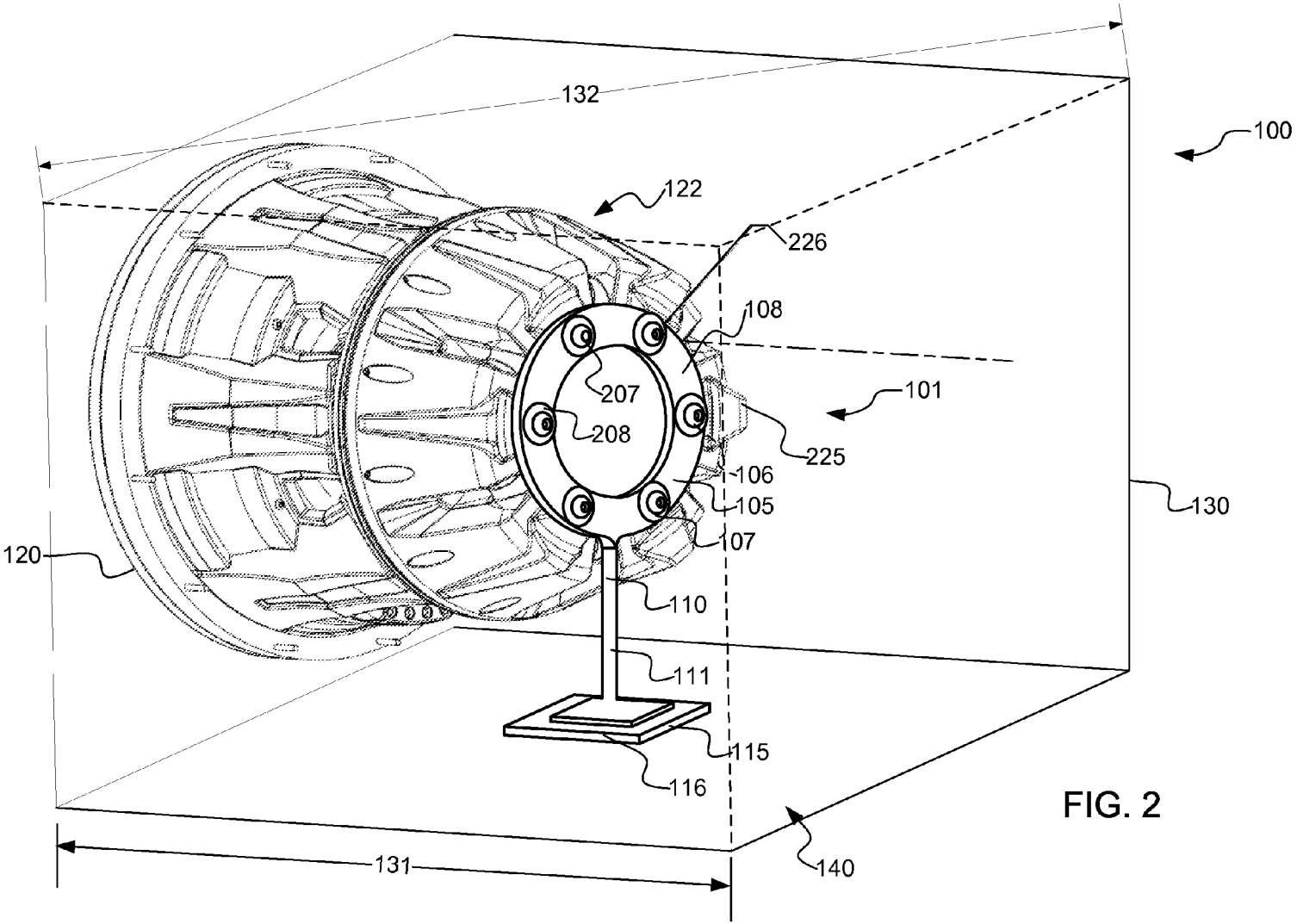
FIG. 2 shows a perspective view, illustrating the speaker support according to the preferred embodiment of FIG. 1, showing the speaker support in place between a speaker basket and a speaker cabinet.

FIG. 2 shows a perspective view, illustrating speaker support 101 according to the preferred embodiment of FIG. 1, showing speaker support 101 in place between speaker basket 225 and speaker cabinet 130. Speaker basket 225 should be visible through the center of annular plate 108, although the center is whited out in this view for numbering purposes. Speaker 120 comprises speaker basket 225, as shown. Preferably, speaker basket 225 comprises metal.

Speaker support 101 is fastened between speaker basket 225 and speaker cabinet 130, as shown. Preferably, speaker support 101 is in direct contact with speaker basket 225 and with speaker cabinet 130, as shown. Preferably, vibration damper 105 comprises six fastener-holes 106 arrayed in a hexagonal pattern about the circumference of annular plate 108, as shown. Preferably, speaker basket 225 comprises basket fastener-holes 226, as shown. Preferably, fastener-holes 106 are adapted to align with basket fastener-holes 226, as shown. Fasteners 107 pass through fastener-holes 106 and through basket fastener-holes 226, as shown. Preferably, fasteners 107 are tightened to compress vibration damper 105 between speaker basket 225 and fasteners 107, as shown. Preferably, basket fastener-holes 226 are threaded. Preferably, fasteners 107 comprise screws 207, preferably with washers 208, as shown. Upon reading the teachings of this specification, those with ordinary skill in the art will now understand that, under appropriate circumstances, considering such issues as advances in technology, user preference, etc., fastener adaptations other than fastener holes 106 and basket fastener-holes 226 with corresponding other fasteners 107, such as snap fittings, adhesive, welding, etc., may suffice.

Connector 115 is fastened to a remote portion of speaker cabinet 130 away from vibration damper 105, as shown. Prior-art methods of fastening speaker basket 225 directly to speaker cabinet 130 resulted in primary-mode resonance in speaker cabinet 130 that damaged speaker cabinet 130 and speaker basket 225. The Inventors have discovered that speaker support 101 prevents primary-mode resonance from building up to damaging levels in speaker cabinet 130. Preferably, speaker 120 is a woofer, preferably a large automotive woofer such as, for example, the 380-pound subwoofer built to be installed in 2007 model year Cadillac Escalades™.

Figure 3:
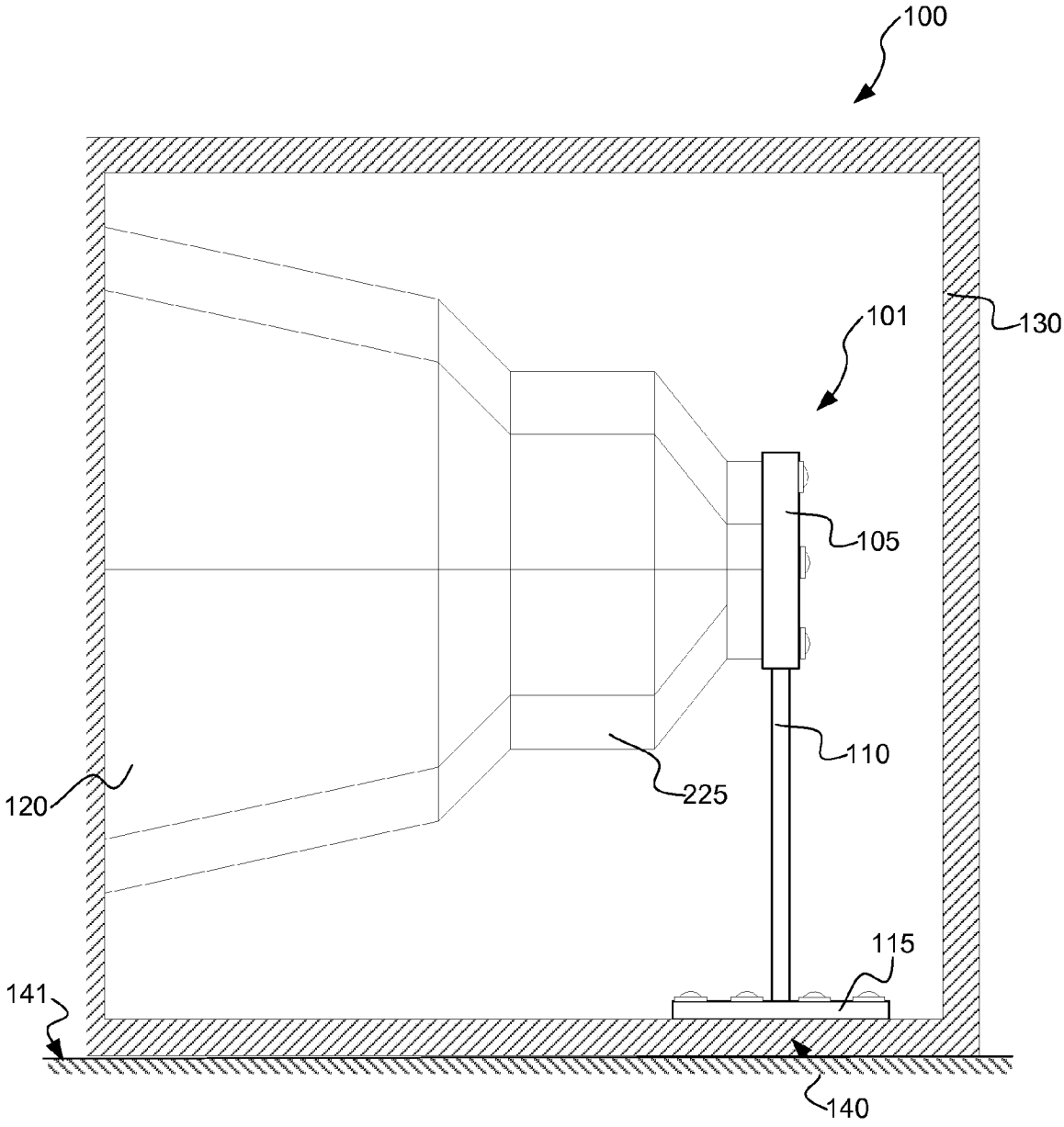
FIG. 3 shows a side view illustrating the speaker support according to the preferred embodiment of FIG. 1, showing the speaker support in place between a speaker basket and a speaker cabinet.

FIG. 3 shows a side view illustrating speaker support 101 according to the preferred embodiment of FIG. 1, showing speaker support 101 in place between speaker basket 225 and speaker cabinet 130. Vibration damper 105 is fastened to speaker 120, as shown. Speaker support 101 is fastened between speaker 120 and speaker cabinet 130 and is in direct contact with speaker 120 and with speaker cabinet 130, as shown. Preferably, speaker support 101 is fastened between speaker basket 225 and speaker cabinet 130 and is in direct contact with speaker basket 225 and with speaker cabinet 130, as shown. Vibration sink 140 is shown mounted on environmental surface 141.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A speaker support, relating to supporting at least one speaker by at least one anterior portion of at least one speaker basket of such at least one speaker, comprising:

a) at least one vibration damper structured and arranged to damp sound vibrations that are passing from such at least one anterior portion of at least one speaker basket toward at least one speaker cabinet enclosing such at least one speaker;

b) at least one vibration transferer adapted to transfer such damped sound vibrations from said at least one vibration damper to at least one vibration sink;

c) at least one connector adapted to connect said at least one vibration transferer to such at least one vibration sink;

d) wherein said at least one vibration transferer is tuned to not resonate at any primary resonant frequency of such at least one speaker cabinet and wherein said at least one vibration damper comprises at least one fastener-hole adapted to receive at least one fastener.

2. The speaker support, according to claim 1, further comprising such at least one speaker cabinet, wherein said at least one vibration transferer comprises at least one length that is not an integer dividend of, and is not an integer product of, one of any side length and any diagonal length of said at least one speaker cabinet.

3. The speaker support, according to claim 1, wherein said at least one vibration transferer comprises metal.

4. The speaker support, according to claim 1, wherein said at least one vibration transferer comprises at least one metal rod.

5. The speaker support, according to claim 1, wherein said at least one connector comprises at least one metal bracket.

6. The speaker support, according to claim 1, wherein said at least one vibration damper is further sized, shaped, and arranged to provide structural support to such at least one speaker basket.

7. The speaker support, according to claim 1, a) wherein said at least one vibration damper is adapted to be fastened to such at least one anterior portion of such at least one speaker and is adapted to be coupled to said at least one vibration transferer;

b) wherein said at least one vibration transferer is adapted to be coupled to said at least one connector; and c) wherein said at least one connector is adapted to be coupled to such at least one speaker cabinet.

8. The speaker support, according to claim 1, wherein said at least one vibration damper comprises at least one metal plate.

9. The speaker support, according to claim 1, wherein said at least one vibration damper comprises at least one annulus having a plurality of axial fastener-holes arrayed about said at least one annulus.

10. The speaker support, according to claim 9, wherein said at least one vibration damper comprises six fastener-holes arrayed in a hexagonal pattern about said at least one annulus.

11. The speaker support, according to claim 1, further comprising such at least one speaker.

12. The speaker support, according to claim 11, wherein said at least one speaker comprises at least one woofer.

13. The speaker support, according to claim 1, further comprising such at least one speaker cabinet.

14. The speaker support, according to claim 1, further comprising such at least one vibration sink.

15. The speaker support, according to claim 14, wherein said at least one vibration sink comprises such at least one speaker cabinet.

16. A speaker support, comprising:

a) at least one metal vibration damper structured and arranged to damp sound vibrations that are passing from at least one anterior portion of at least one speaker basket of at least one speaker toward at least one proximate portion of at least one speaker cabinet that is adapted to enclose such at least one speaker;

b) at least one metal vibration transferer adapted to transfer such damped sound vibrations from said at least one vibration damper to at least one remote portion of such at least one speaker cabinet; and c) at least one metal connector adapted to connect such at least one vibration transferer to such at least one remote portion of such at least one speaker cabinet;

d) wherein said at least one vibration transferer is tuned to not resonate at any primary-mode resonant frequency of such at least one speaker cabinet;

e) whereby such damped sound vibrations are transferred from such at least one speaker to such at least one remote portion of such at least one speaker cabinet.

17. A speaker support, comprising:

a) at least one speaker comprising at least one speaker basket having at least one anterior portion;

b) at least one speaker cabinet adapted to enclose said at least one speaker;

c) at least one vibration damper structured and arranged to damp sound vibrations that are passing from said at least one anterior portion of said at least one speaker basket toward at least one proximate portion of said at least one speaker cabinet;

d) wherein said at least one vibration damper is structured and arranged to be fastened to said at least one anterior portion of said at least one speaker;

e) wherein said at least one vibration damper comprises a plurality of transverse fastener-holes arrayed around at least one annular plate;

f) at least one vibration transferer adapted to transfer such damped sound vibrations from said at least one vibration damper to at least one remote portion of said at least one speaker cabinet;

g) wherein said at least one vibration transferer comprises at least one metal rod;

h) at least one connector adapted to connect said at least one vibration transferer to such at least one remote portion of said at least one speaker cabinet;

i) wherein said at least one vibration transferer is tuned to not resonate at any primary-mode resonant frequency of said at least one speaker cabinet;

j) whereby such damped sound vibrations are transferred from said at least one anterior portion of said at least one speaker basket to such at least one remote portion of said at least one speaker cabinet.

18. The speaker support, according to claim 17, wherein said at least one vibration damper comprises six axial fastener-holes arrayed in a radially symmetric hexagonal pattern in said at least one annular plate.

19. The speaker support, according to claim 17, wherein said at least one speaker comprises at least one woofer adapted to be mounted in at least one automobile.

* * * * *